US006465942B2

(12) United States Patent
Ito et al.

(10) Patent No.: US 6,465,942 B2
(45) **Date of Patent: *Oct. 15, 2002**

(54) COLOR CATHODE RAY HAVING A SHADOW MASK STRUCTURE WITH CURL REDUCED IN A SKIRT PORTION THEREOF

(75) Inventors: Hiroshi Ito; Koji Hagiwara, both of Mobara (JP)

(73) Assignees: Hitachi, Ltd., Tokyo (JP); Hitachi Electronic Devices Co., Ltd., Mobara (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/886,132

(22) Filed: Jun. 22, 2001

(65) Prior Publication Data

US 2001/0035707 A1 Nov. 1, 2001

Related U.S. Application Data

(63) Continuation of application No. 09/296,258, filed on Apr. 22, 1999, now Pat. No. 6,255,765.

(30) Foreign Application Priority Data

Apr. 24, 1998 (JP) ..... 10-115194

(51) Int. Cl.[7] ..... H01J 29/80

(52) U.S. Cl. ..... 313/402; 313/403; 313/404; 313/407

(58) Field of Search ..... 313/402, 403, 313/404, 407, 408

(56) References Cited

U.S. PATENT DOCUMENTS

| | | | | |
|---|---|---|---|---|
| 3,351,996 A | | 11/1967 | Fiore | 445/37 |
| 3,585,431 A | | 6/1971 | Long | 313/407 |
| 3,855,493 A | | 12/1974 | Snook et al. | 313/402 |
| 3,862,448 A | | 1/1975 | Ishizuka et al. | 313/402 |
| 3,878,427 A | | 4/1975 | Godfrey | 313/402 |
| 3,912,963 A | | 10/1975 | Sedivy | 313/402 |
| 4,122,368 A | | 10/1978 | Masterton | 313/403 |
| 4,146,816 A | | 3/1979 | Morrell | 313/407 |
| 4,327,307 A | | 4/1982 | Penird et al. | 313/407 |
| 4,437,036 A | | 3/1984 | Ragland, Jr. | 313/402 |
| 4,949,009 A | | 8/1990 | Iwamoto | 313/407 |
| 5,030,880 A | | 7/1991 | An | 313/403 |
| 5,384,511 A | * | 1/1995 | Fujimura | 313/402 |
| 5,576,595 A | | 11/1996 | Inoue | 313/402 |
| 6,111,346 A | * | 8/2000 | Ito et al. | 313/402 |
| 6,255,765 B1 | * | 7/2001 | Ito et al. | 313/402 |
| 6,323,589 B1 | * | 11/2001 | Inoue et al. | 313/402 |

FOREIGN PATENT DOCUMENTS

| | | |
|---|---|---|
| JP | 10-255680 | 9/1998 |

* cited by examiner

*Primary Examiner*—Vip Patel
*Assistant Examiner*—Kevin Quarterman
(74) *Attorney, Agent, or Firm*—Antonelli, Terry, Stout & Kraus, LLP

(57) ABSTRACT

A color cathode ray tube includes a generally rectangular shadow mask having a curved apertured portion having a multiplicity of electron-transmissive apertures, a curved imperforate portion surrounding and integral with the apertured portion and a skirt portion bent back from a periphery of the curved imperforate portion, and a generally rectangular support frame for suspending the shadow mask by spot welding the skirt portion thereto, within a panel portion of the color cathode ray tube. The skirt portion is provided with a plurality of embossments and is fitted inside the support frame. The embossments protrude inwardly and extend in a direction of a height of the skirt portion. A distance between a bottom of each of the plurality of embossments and a border of the curved apertured portion is at least 4.5 mm.

22 Claims, 7 Drawing Sheets

COLOR CATHODE RAY HAVING A SHADOW MASK STRUCTURE WITH CURL REDUCED IN A SKIRT PORTION THEREOF

CROSS REFERENCE TO RELATED APPLICATION

This is a continuation of U.S. application Ser. No. 09/296,258, filed Apr. 22, 1999, now U.S. Pat. No. 6,255,765, the subject matter of which is incorporated by reference herein.

BACKGROUND OF THE INVENTION

The present invention relates to a shadow mask type color cathode ray tube, and more particularly to a color cathode ray tube having a shadow mask provided with press-formed embossments in a skirt portion thereof of such dimensions that concentration of stress in an apertured portion of the shadow mask is prevented in the operation of fitting the skirt portion of the shadow mask into a support frame.

In general, a shadow mask for use in a color cathode ray tube is press-formed and it has an apertured portion having a multiplicity of electron-transmissive apertures, an imperforate portion surrounding and integral with the aperture portion and a skirt portion bent back from a periphery of the imperforate portion. The skirt portion of the shadow mask is fitted in a support frame, is spot-welded to the support frame and fixed in a panel portion of the color cathode ray tube such that the imperforate portion of the shadow mask faces a phosphor screen coated on an inner surface of a faceplate of a panel portion.

FIGS. 4A to 4C are respectively structural views showing an example of the shadow mask used in a conventional color cathode ray tube. FIG. 4A is a front view of the shadow mask, FIG. 4B is a side view of a short side of the shadow mask, and FIG. 4C is a fragmentary sectional view of a region extending from the imperforate portion to the skirt portion.

In FIGS. 4A to 4C, reference numeral 40 designates a shadow mask, 41 is an apertured portion, 42 is an imperforate portion, 43 is a skirt portion, and x marks are weld points. The shadow mask 40 has a curved apertured portion 41 having a multiplicity of electron-transmissive apertures (not shown), a curved imperforate portion 42 surrounding and integral with the apertured portion 41 and a skirt portion 43 bent back from a periphery of the curved imperforate portion 42 and is usually integrally formed by press-forming a multi-apertured thin sheet-like metal blank.

The multi-apertured thin sheet-like metal blank is very thin and therefore the press-formed shadow mask 41 is not always good in forming characteristics. The strength of the thin sheet-like metal blank is relatively weak and the shape of the shadow mask 40 obtainable by press-forming is limited. The corners of the shadow mask 40 are bent back from the curved imperforate portion 42 to form the skirt portion 43 with a smoothly falling curve, or are bent back stepwise from the curved imperforate portion 42 to form the skirt portion 43 with at least one step. The portion between the corners of the shadow mask 40 is bent back from the curved imperforate portion 42 with a relatively small radius to form the skirt portion 43. As a result, the skirt portion 43 of the shadow mask 40 curls outwardly by a distance ΔS from a straight line passing through a bend line between the imperforate portion 42 and the skirt portion 43 and parallel to the longitudinal axis of the cathode ray tube, in a region between the corners of the shadow mask 40, as shown in FIG. 4C.

The fixation of the press-formed shadow mask 40 to a support frame (not shown) is performed as follows: the skirt portion 43 of the shadow mask 40 is fitted inside the support frame (rarely outside the support frame), and is spot-welded to the support frame at several weld points marked with X as shown in FIG. 4B. The number of the weld points of the skirt portion 43 and the support frame are two on each long side, two on each short side and one at each corner of the shadow mask 40, for example.

Large curl ΔS is always easily made in the skirt portion 43 in press-forming the above-explained conventional shadow mask 40. If the size of the curl ΔS exceeds an acceptable limit, the problem arises in that the curl ΔS is an obstacle to fitting the skirt portion 43 into the support frame and degrades workability of the fitting operation. If the skirt portion 43 having a large curl ΔS is forcibly fitted into the support frame, the stress caused to the skirt portion 43 is transmitted to the imperforate portion 42 and the apertured portion 41, distorts the curved contour of the apertured portion 41 of the shadow mask 40, and as a result, the color selection property of the shadow mask 40 is degraded.

To solve these problems, Japanese Patent Application No. Hei 9-56286 filed (laid-open on Sep. 25, 1998) by the same applicants as the present application, which corresponds to the copending application Ser. No. 09/035,896, which issued as U.S. Pat. No. 6,111,346, proposes a color cathode ray tube which is provided with a plurality of embossments and a plurality of notches around the circumference of the long and short sides of the skirt portion 43 of the shadow mask 40 such that the embossments extend in a direction of the height of the skirt portion 43 and project arcuately toward the imperforate portion 42, and such that the notches are disposed between two adjacent ones of the embossments 43 and extend a fraction of the height of the skirt portion 43 in the direction of the height of the skirt portion, in order to limit the size of curls ΔS occurring in the skirt portion 43, the embossments and notches being formed in the operation of press-forming the shadow mask 40.

In the above proposal, the plural embossments and notches formed in the skirt portion 43 limit the size of the curls ΔS occurring in the skirt portion 43 such that concentration of stress in an apertured portion 41 of the shadow mask 40 is prevented in the operation of fitting the skirt portion 43 of the shadow mask 40 into a support frame.

SUMMARY OF THE INVENTION

It is one of the present invention to provide a shadow mask type color cathode ray tube provided with a shadow mask structure for preventing concentration of stress in an apertured portion of the shadow mask in the operation of fitting the skirt portion of the shadow mask into a support frame, by reducing the size of the curls ΔS occurring in the skirt portion of the press-formed shadow mask more effectively.

For achieving the aforesaid object, in accordance with an embodiment of the present invention, there is provided a color cathode ray tube comprising a generally rectangular shadow mask having a curved apertured portion having a multiplicity of electron-transmissive apertures, a curved imperforate portion surrounding and integral with the apertured portion and a skirt portion bent back from a periphery of the curved imperforate portion, and a generally rectangular support frame for suspending the shadow mask by spot welding the skirt portion thereto, with a panel portion of the color cathode ray tube; the skirt portion being provided with a plurality of embossments and being fitted inside the support frame, the plurality of embossments protruding inwardly and extending in a direction of a height of the skirt portion, and a distance between a bottom of each of the plurality of embossments and a border of the curved apertured portion being at least 4.5 mm.

With the structure of the present invention, the size of the curls ΔS occurring in the skirt portion of the press-formed shadow mask is reduced to a greater extent, concentration of stress caused by large-sized curls of the skirt portion in an apertured portion of the shadow mask is reduced or eliminated in the operation of fitting the skirt portion of the shadow mask into a support frame, and consequently occurrence of deformation of the apertured portion is eliminated.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

A shadow mask type color cathode ray tube of an embodiment of the present invention includes a generally rectangular shadow mask having a curved apertured portion having a multiplicity of electron-transmissive apertures, a curved imperforate portion surrounding and integral with the apertured portion and a skirt portion bent back from a periphery of the curved imperforate portion, and a generally rectangular support frame for suspending the shadow mask by spot welding its skirt portion, within a panel portion of the color cathode ray tube. The long and short sides of the skirt portion are provided with a plurality of embossments extending in a direction of a height of the skirt portion, the depth of each embossment and the width of each embossment at its mouth are in a range of 0.2 to 1.0 mm and in a range of 4.0 to 12.0 mm, respectively, and a distance between the bottom of the embossment and the border of the apertured portion is at least 4.5 mm.

In an embodiment of the present invention, a distance between the bottom of an embossment and the border of the apertured portion increases with decreasing distance from a centerline of the long or short side of the skirt portion of a shadow mask.

In another embodiment of the present invention, a distance between the bottom of an embossment and the border of the apertured portion decreases with decreasing distance from a centerline of the long or short side of the skirt portion of a shadow mask.

In another embodiment of the present invention, notches are disposed between two adjacent ones of the plural embossments in the long and short sides of the skirt portion of a shadow mask and extend a fraction of the height of the skirt portion from its rear end opposite from the faceplate in the direction of the height of the skirt portion.

In these embodiments of the present invention, simultaneously with press-forming of a shadow mask, a plurality of embossments are formed in the long and short sides of the skirt portion such that the depth of each embossment and the width of each embossment at its mouth are in a range of 0.2 to 1.0 mm and in a range of 4.0 to 12.0 mm, respectively, and a distance between the bottom of the embossment and the border of the apertured portion is at least 4.5 mm. With this structure, the size of curls occurring in the skirt portion is greatly reduced, concentration of stress caused by large-sized curls of the skirt portion in an apertured portion of the shadow mask is reduced or eliminated in the operation of fitting the skirt portion of the shadow mask into a support frame, and consequently occurrence of deformation of the apertured portion is eliminated. Therefore the present invention provides a shadow mask type color cathode ray tube free from errors in registration of colors in a displayed image caused by deformation of the shadow mask.

The embodiments of the present invention will be explained hereinafter with reference to the drawings.

Figure 1:
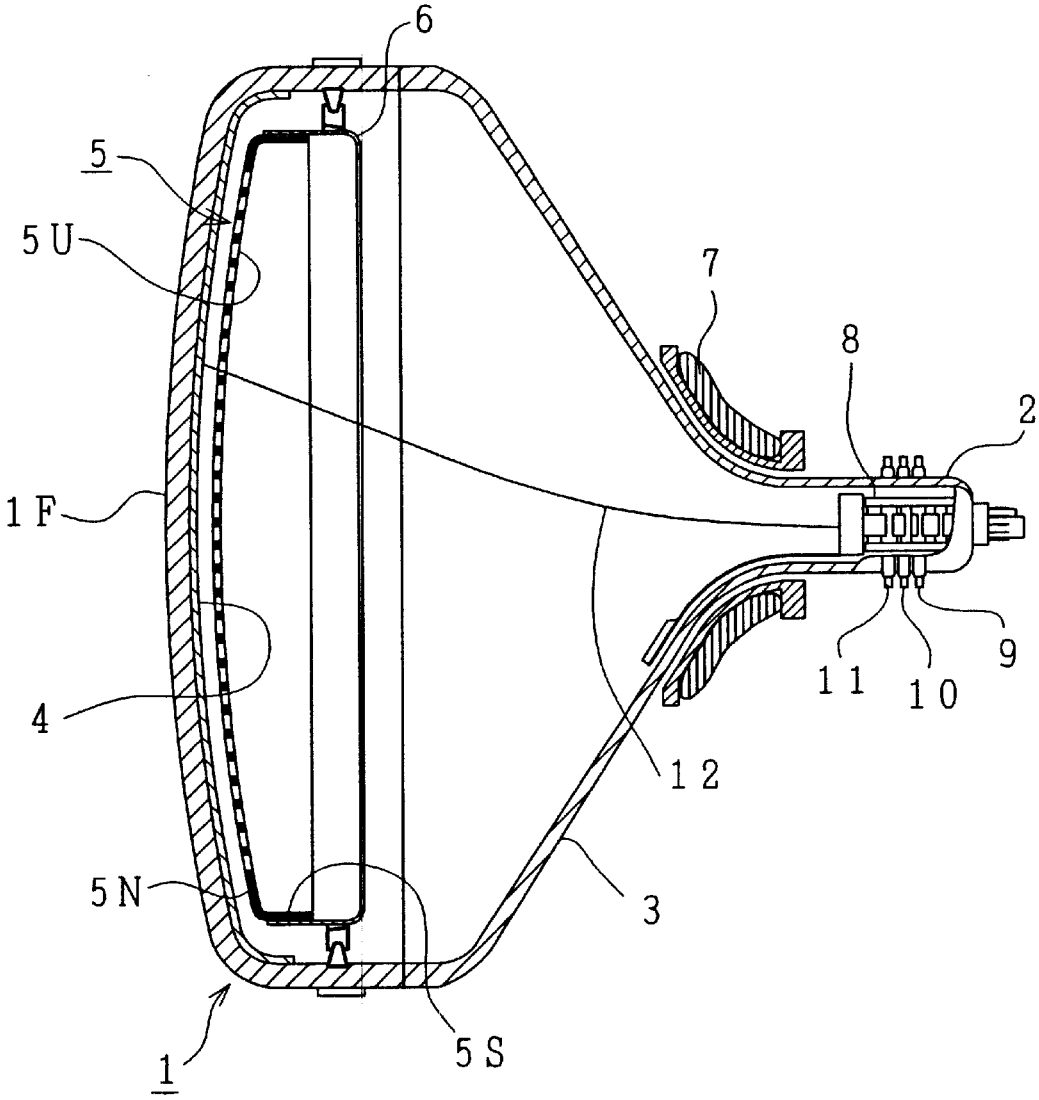
FIG. 1 is a sectional view showing a schematic structure of an embodiment of a shadow mask type color cathode ray tube according to the present invention.

FIG. 1 is a sectional view showing a schematic structure of an embodiment of a color cathode ray tube having a shadow mask according to the present invention.

In FIG. 1, reference numeral 1 designates a panel portion, 1F is a faceplate, 2 is a neck portion, 3 is a funnel portion, 4 is a phosphor screen, 5 is a shadow mask, 5U is an apertured portion of the shadow mask 5, 5N is an imperforate portion of the shadow mask 5, 5S is a skirt portion of the shadow mask 5, 6 is a support frame, 7 is a deflection yoke, 8 is an electron gun, 9 is a purity adjustment magnet, 10 is a four-pole magnet for static convergence adjustment, 11 is a six-pole magnet for static convergence adjustment, and 12 is an electron beam.

An evacuated envelope (bulb) of the color cathode ray 5 tube comprises the panel portion 1 disposed in front, the narrow, long tubular neck portion 2 housing the electron gun 8 therein, and the funnel portion 3 for connecting the panel portion 1 and the neck portion 2. The panel portion 1 has the faceplate 1F in front, and the phosphor screen 4 is deposited on the inner surface of the faceplate IF. The support frame 6 is secured to an inner peripheral portion of the panel portion 1, and the skirt portion 5S of the shadow mask 5 is welded to the support frame 6 such that the apertured portion 5U of the shadow mask 5 is adjacent to the phosphor screen 4. The deflection yoke 7 is disposed around a junction of the funnel portion 3 and the neck portion 2. Externally of the neck portion 2 are juxtaposed the purity adjustment magnet 9, the four-pole magnet 10 for static beam convergence adjustment, and the six-pole magnet 11 for static beam convergence adjustment so that three electron beams 12 (only one of which is shown in FIG. 1) projected from the electron gun 8 pass through, after having been deflected by the deflection yoke 7, the electron-transmissive aperture in the apertured portion 5U of the shadow mask 5 and impinge on the phosphor screen 4.

In this case, the operation of the color cathode ray tube according to the present embodiment, that is, the image displaying operation is almost the same as the image displaying operation in the well-known color cathode ray tube of this kind, and such an operation is well known in the art of this field. Therefore, the explanation of the image displaying operation in the color cathode ray tube in the present embodiment will be omitted.

Figure 2B:
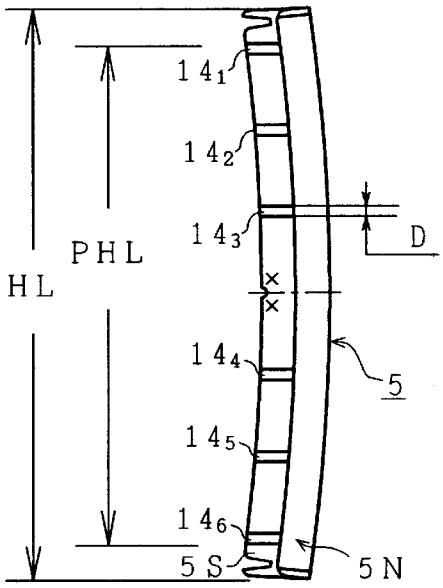
FIGS. 2A to 2D are respectively structural views showing a first embodiment of a shadow mask used in the color cathode ray tube shown in FIG. 1, FIG. 2A being a top view thereof, FIG. 2B being a side view of a long side thereof, FIG. 2C being a side view of a short side thereof, and FIG. 2D being an enlarged fragmentary cross-sectional view of a skirt portion thereof.
Figure 2A:
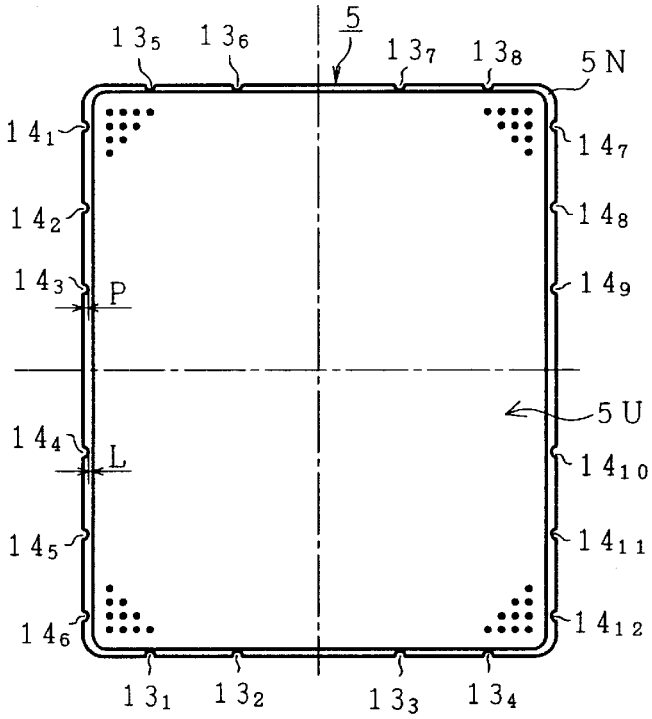
Figure 2D:
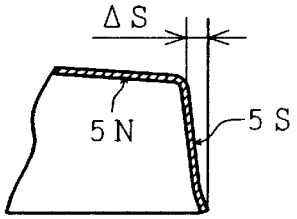
Figure 2C:
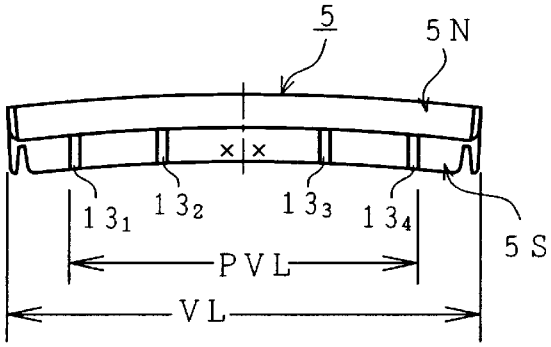

FIGS. 2A to 2D are respectively structural views showing a first embodiment of a shadow mask 5 used for the color cathode ray tube shown in FIG. 1, FIG. 2A being a top view thereof, FIG. 2B being a side view of a long side thereof, FIG. 2C being a side view of a short side thereof, FIG. 2D being an enlarged fragmentary perspective view of the imperforate and skirt portions thereof.

In FIGS. 2A to 2D, reference numerals $\mathbf{13}_1$, $\mathbf{13}_2$, $\mathbf{13}_3$, $\mathbf{13}_4$, $\mathbf{13}_5$, $\mathbf{13}_6$, $\mathbf{13}_7$, and $\mathbf{13}_8$, designate embossments provided in the short sides of the skirt portion 5S; reference numerals $\mathbf{14}_1$, $\mathbf{14}_2$, $\mathbf{14}_3$, $\mathbf{14}_4$, $\mathbf{14}_5$, $\mathbf{14}_6$, $\mathbf{14}_7$, $\mathbf{14}_8$, $\mathbf{14}_9$, $\mathbf{14}_{10}$, $\mathbf{14}_{11}$, and $\mathbf{14}_{12}$ designate embossments provided in the long sides of the skirt portion 5S. The same reference numerals as utilized in FIG. 1 designate corresponding elements. X marks designate welds. The shadow mask 5 comprises an apertured portion 5U in the form of a curved contour provided with a multiplicity of electron-transmissive apertures, an imperforate portion 5N in the form of a curved contour surrounding and integral with the apertured portion 5U, and a skirt portion 5S bent back from a periphery of the imperforate portion 5N.

The embossments $\mathbf{13}_1$ to $\mathbf{13}_4$ and the embossments $\mathbf{13}_5$ to $\mathbf{13}_8$ are provided on one of the short sides and the other of the short sides of the skirt portion 5S of the shadow mask 5, respectively, and the embossments $\mathbf{14}_1$ to $\mathbf{14}_6$ and the embossments $\mathbf{14}_7$ to $\mathbf{14}_{12}$ are provided on one of the long sides and the other of the long sides of the skirt portion 5S of the shadow mask 5, respectively.

The embossments $\mathbf{13}_1$ to $\mathbf{13}_8$ and $\mathbf{14}_1$ to $\mathbf{14}_{12}$ are arcuate in cross section, protrude arcuately and inwardly toward the imperforate portion 5N and extend in a direction of the height of the skirt portion 5S.

The depth P of the embossments and the width D at the mouth of the embossments are 0.6 mm and 0.8 mm, respectively, as defined in FIGS. 2A and 2B, and the distance L between the bottom of the embossments and the border of the apertured portion 5U is 5.0 mm, as defined in FIG. 2A. The embossments are formed integrally with the skirt portion and simultaneously with press-forming the skirt portion 5S in the operation of press-forming a sheet-like metal blank into the shadow mask 5.

With such a structure, the embossments $\mathbf{13}_1$ to $\mathbf{13}_8$ and $\mathbf{14}_1$ to $\mathbf{14}_{12}$ are formed integrally with the skirt portion 5S of the shadow mask and simultaneously with the press-forming of the skirt portion 5S in the operation of press-forming the sheet-like metal blank into the shadow mask 5 and the dimensions of the embossments are optimized, and consequently the size of curls ΔS occurring in the skirt portion 5S can be suppressed within the acceptable limit.

The curls ΔS suppressed within the acceptable limit do not cause concentration of stress in the apertured portion 5U of the shadow mask 5 in the operation of fitting the skirt portion 5S into the support 6 and consequently do not deform the apertured portion 5U.

Figure 3B:
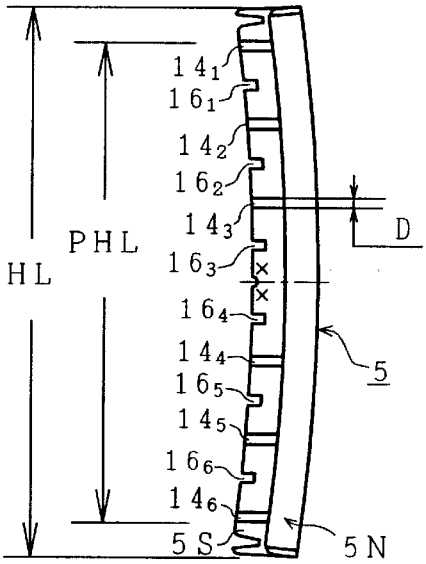
FIGS. 3A to 3C are respectively structural views showing a second embodiment of a shadow mask used in the color cathode ray tube shown in FIG. 1, FIG. 3A being a top view thereof, FIG. 3B being a side view of a long side thereof, and FIG. 3C being a side view of a short side thereof.
Figure 3A:
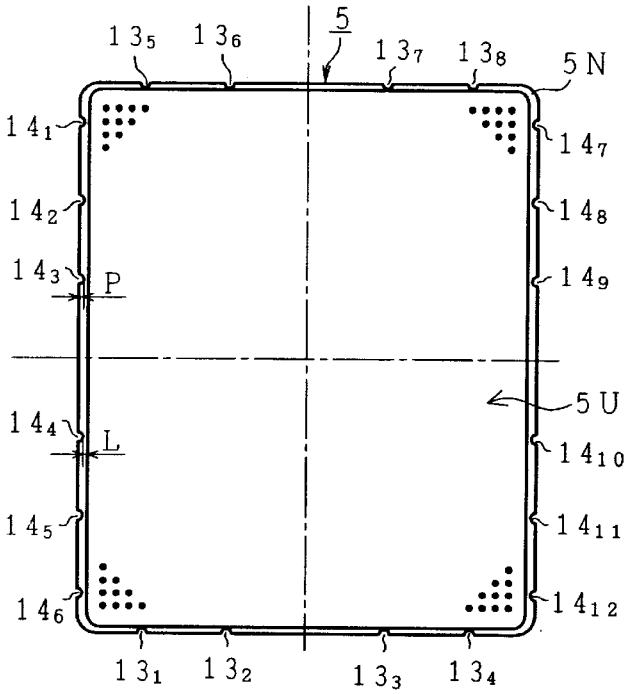
Figure 3C:
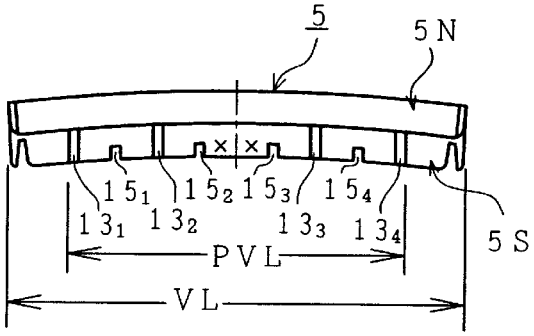
Figure 4A:
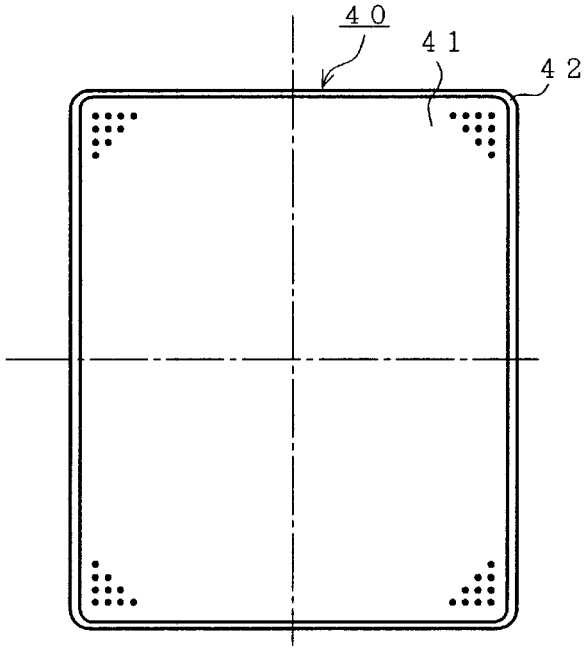
FIG. 4A (PRIOR ART)
FIGS. 4A to 4C are respectively structural views showing one example of a shadow mask used in a conventional color cathode ray tube, FIG. 4A being a top view thereof, FIG. 4B being a side view of a short side thereof, and FIG. 4C being an enlarged fragmentary cross-sectional view of a skirt portion thereof.
Figure 4B:
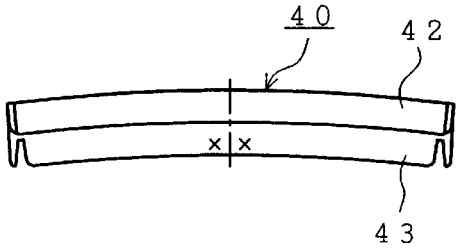
FIG. 4B (PRIOR ART)
Figure 4C:
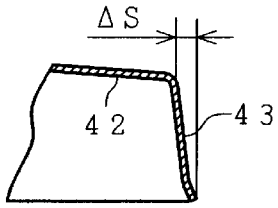
FIG. 4C (PRIOR ART)

FIGS. 3A to 3C are respectively structural views showing a second embodiment of a shadow mask 5 used for the color. cathode ray tube shown in FIG. 1, FIG. 3A being a top view thereof, FIG. 3B being a side view of a long side thereof, FIG. 3C being a side view of a short side thereof.

In FIGS. 3A to 3C, reference numerals $\mathbf{15}_1$, $\mathbf{15}_2$, $\mathbf{15}_3$, $\mathbf{15}_4$ designate notches provided in one of the two short sides of the skirt portion 5S of the shadow mask 5; reference numerals $\mathbf{16}_1$, $\mathbf{16}_2$, $\mathbf{16}_3$, $\mathbf{16}_4$, $\mathbf{16}_5$, $\mathbf{16}_6$ designate notches provided in one of the two long sides of the skirt portion 5S. The same reference numerals as utilized in FIGS. 2A to 2D designate corresponding elements.

Although not shown in FIGS. 3A to 3C, a plurality of notches are provided in the other of the two short sides of the skirt portion 5S like the notches $\mathbf{15}_1$ to $\mathbf{15}_4$ on the one of the two short sides, and a plurality of notches are provided in the other of the two long sides of the skirt portion 5S like the notches $\mathbf{16}_1$ to $\mathbf{16}_6$ on the one of the two long sides. The embossments $\mathbf{13}_1$ to $\mathbf{13}_8$ and $\mathbf{14}_1$ to $\mathbf{14}_{12}$ on the short and long sides of the skirt portion 5S are identical in dimension with the embossments $\mathbf{13}_1$ to $\mathbf{13}_8$ and $\mathbf{14}_1$ to $\mathbf{14}_{12}$ in the first embodiment.

The only structural difference between the shadow masks of the first and second embodiments is that, while the shadow mask of the first embodiment is provided with a plurality of embossments $\mathbf{13}_1$ to $\mathbf{13}_8$ and $\mathbf{14}_1$ to $\mathbf{14}_{12}$ in the sides of the skirt portion 5S, the shadow mask of the second embodiment is provided with a plurality of notches in each side of the skirt portion 5S in addition to a plurality of embossments $\mathbf{13}_1$ to $\mathbf{13}_8$ and $\mathbf{14}_1$ to $\mathbf{14}_{12}$ in the sides of the skirt portion 5S, and therefore further explanation about the structure of the second embodiment is omitted.

Also, the advantages obtained by using the shadow mask of the second embodiment is substantially the same as those obtained by the first embodiment, and therefore the explanation of the advantages obtainable by the second embodiment is omitted.

Incidentally, in the shadow masks of the first and second embodiments, the depth P of the embossments and the width D at the mouth of the embossments $\mathbf{13}_1$ to $\mathbf{13}_8$ and $\mathbf{14}_1$ to $\mathbf{14}_{12}$ provided on the long and short sides of the skirt portion 5S are 0.6 mm and 8.0 mm, respectively, and the distance L between the bottom of the embossments and the border of the apertured portion is 5.0 mm, but the dimensions of the embossments suitable for the present invention are not limited to those values. It was experimentally confirmed that, if the depth P of the embossments is in a range of 0.2 mm to 1.0 mm, the width D at the mouth of the embossments is in a range of 4.0 mm to 12.0 mm and the distance between the bottom of the embossments and the border of the apertured portion 5U is at least 4.5 mm, the shadow mask can provide the advantages similar to those obtained by the shadow masks of the first and second embodiments.

In the shadow masks of the first and second embodiments, all of the embossments $\mathbf{13}_1$ to $\mathbf{13}_8$ and $\mathbf{14}_1$ to $\mathbf{14}_{12}$ provided on the long and short sides of the skirt portion 5S have the same depth, but it is not necessary that all the embossments have the same value of the depth P in the present invention.

For example, the shadow mask can be configured such that a depth P of the embossments is made larger in the vicinity of the centerlines of the long and short sides of the skirt portion of the shadow mask S and the depth P of the embossments is made smaller in the vicinity of the ends of the long and short sides of the skirt portion or the corners of the skirt portion of the shadow mask 5.

Figure 5:
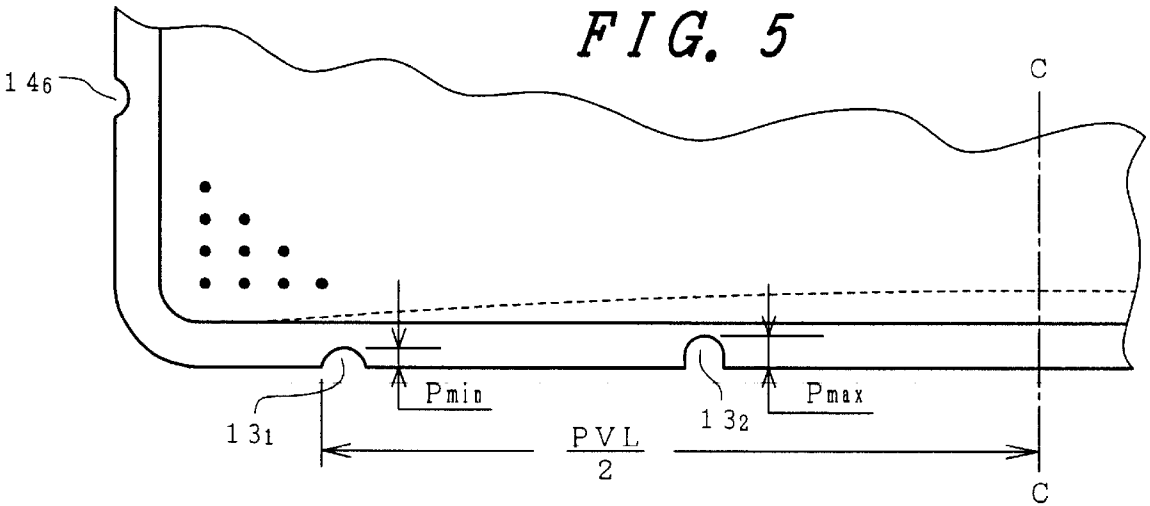
FIG. 5 is an enlarged fragmentary top view of a short side of a skirt portion of a third embodiment of a shadow mask used in the color cathode ray tube shown in FIG. 1.
Figure 6:
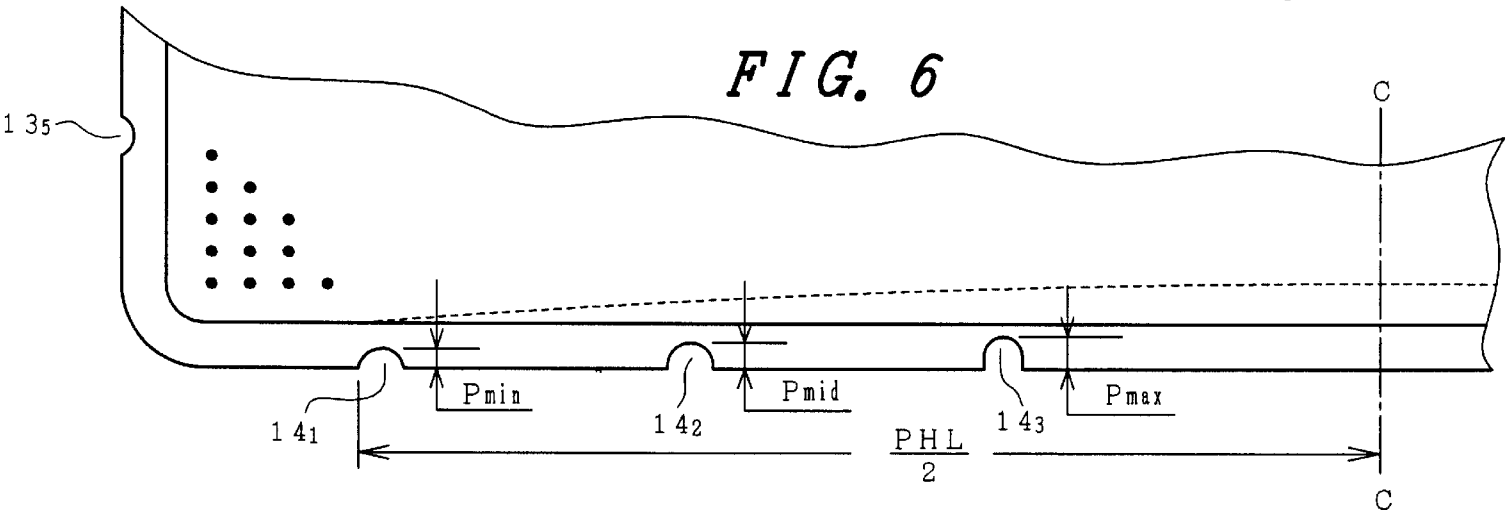
FIG. 6 is an enlarged fragmentary top view of a long side of the skirt portion of the third embodiment of a shadow mask used in the color cathode ray tube shown in FIG. 1.

FIGS. 5 and 6 are fragmentary top views of a shadow mask viewed from a phosphor screen side, of a third embodiment for use in a 19 inch-diagonal color cathode ray tube like the embodiments shown in FIG. 2A and 3A, FIG. 5 being a top view of the embossments $\mathbf{13}_1$ and $\mathbf{13}_2$ provided on the short side of the skirt portion of the shadow mask, and FIG. 6 being a top view of the embossments $\mathbf{14}_1$, $\mathbf{14}_2$ and $\mathbf{14}_3$ provided on the long side of the skirt portion of the shadow mask.

In FIG. 5, the depth Pmax of the embossment 13, nearest the centerline C—C of the short side of the skirt portion is made larger than the depth Pmin of the embossment 131 nearest the corner of the skirt portion. The maximum Pmax and the minimum Pmin of the depth of the embossments in the short side of the skirt portion of the shadow mask for use in a 19 inch-diagonal color cathode ray tube are 0.8 mm and 0.6 mm, respectively.

If the maximum Pmax and the minimum Pmin of the depth of the embossments in each short side of the skirt portion of the shadow mask satisfy the relationship $$0.2 \leqq (P\max\ P\min)/P\max \leqq 0.6,$$

deformation can be suppressed in the useful apertured portion of the shadow mask in the vicinity of the embossment $\mathbf{13}_1$ and the amount of curls of the skirt portion is reduced in the vicinity of weld points positioned near the centerline C—C of the short side of the skirt portion.

Especially, prevention of deformation is very effective when the border on the short side of the useful area of the shadow mask having electron-transmissive apertures is pincushion-shaped as indicated by broken lines in FIG. 5.

In the shadow mask shown in FIG. 5, the left-hand half of the short side with respect to its centerline C—C is provided with two embossments, that is, four embossments are provided in one short side of the skirt portion. In the present invention, the number of embossments in the short side is not limited to four, the advantages of the present invention is given if the number of the embossments in one short side of the skirt portion is at least four, and the depth of the embossments decreases gradually as the embossments go toward the corner of the skirt portion from the centerline C—C of the short side of the skirt portion.

FIG. 6 is a top view of the embossments $\mathbf{14}_1$, $\mathbf{14}_2$ and $\mathbf{14}_3$ provided on the long side of the skirt portion of the shadow mask.

The depth Pmax of the embossment $\mathbf{14}_3$ nearest the centerline C—C of the long side of the skirt portion is made larger than the depth Pmin of the embossment $\mathbf{14}_1$ nearest the corner of the skirt portion, and the depth Pmid of the embodiment $\mathbf{14}_2$ positioned between the embossments $\mathbf{14}_1$ and $\mathbf{14}_3$ is made larger than the depth Pmin, but smaller than the depth Pmax. The relationship in size between the embossments is that Pmin≦Pmid≦Pmax.

The maximum Pmax and the minimum Pmin of the depth of the embossments in the long side of the skirt portion of the shadow mask for use in a 19 inch-diagonal color cathode ray tube are 0.8 mm and 0.6 mm, respectively.

If the maximum Pmax and the minimum Pmin of the depth of the embossments in each long side of the skirt portion of the shadow mask satisfy the relationship 0.2≦(Pmax−Pmin)/Pmax≦0.6, deformation can be suppressed in the useful apertured portion of the shadow mask in the vicinity of the embossment $\mathbf{14}_1$ nearest the corner of the skirt portion and the amount of curls of the skirt portion is reduced in the vicinity of weld points positioned near the centerline C—C of the long side of the skirt portion.

Especially, prevention of deformation is very effective when the border on the long side of the useful area of the shadow mask having electron-transmissive apertures is pincushion-shaped as indicated by broken lines in FIG. 6, that is, the border of the curved apertured portion is convex toward a center of the apertured portion.

In the shadow mask shown in FIG. 6, the left-hand half of the long side with respect to its centerline C—C is provided with three embossments, that is, six embossments are provided in one short side of the skirt portion. In the present invention, the number of embossments in the long side is not limited to six, the advantages of the present invention is given if the number of the embossments in one long side of the skirt portion is at least four, and the depth of the embossments decreases gradually as the embossments go toward the corner of the skirt portion from the centerline C—C of the long side of the skirt portion.

Figure 7:
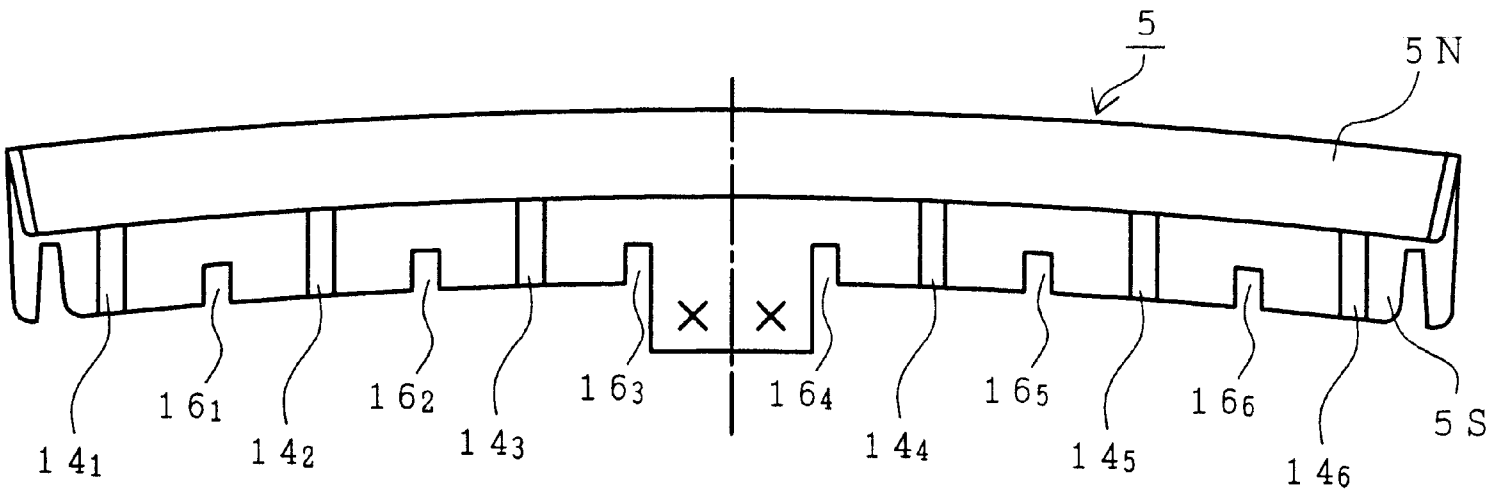
FIGS. 7 is a side view of a long side of the skirt portion of the third embodiment of a shadow mask used in the color cathode ray tube shown in FIG. 1.

FIG. 7 is a side view of a long side of a skirt portion of a shadow mask of another embodiment. A portion of the skirt portion in its long side in the vicinity of two weld points indicated by X's extends longer in a direction of the longitudinal axis of the cathode ray tube than the remainder of the skirt portion in the long side. The same reference numerals as utilized in FIGS. 3B and 5 designate corresponding elements in FIG. 7. The provision of the embossments shown in FIG. 5 or FIG. 6 in the shadow mask 5 shown in FIG. 7 reduces curls occurring in the vicinity of the weld points in the skirt portion.

Figure 8:
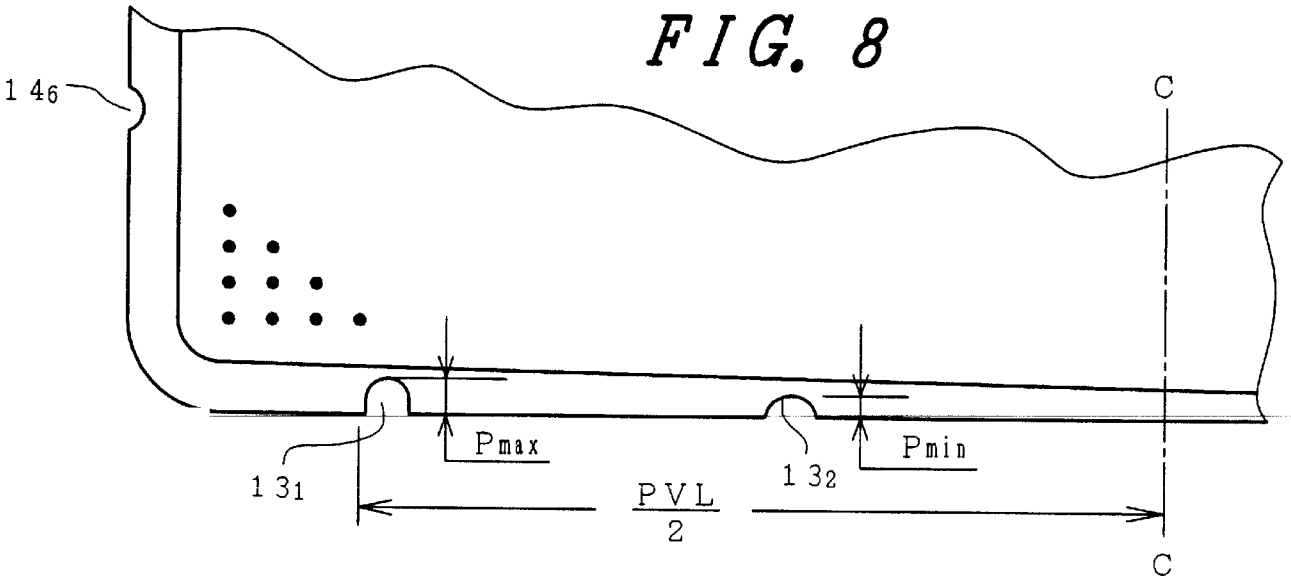
FIG. 8 is an enlarged fragmentary top view of a short side of a skirt portion of a fourth embodiment of a shadow mask used in the color cathode ray tube shown in FIG. 1.
Figure 9:
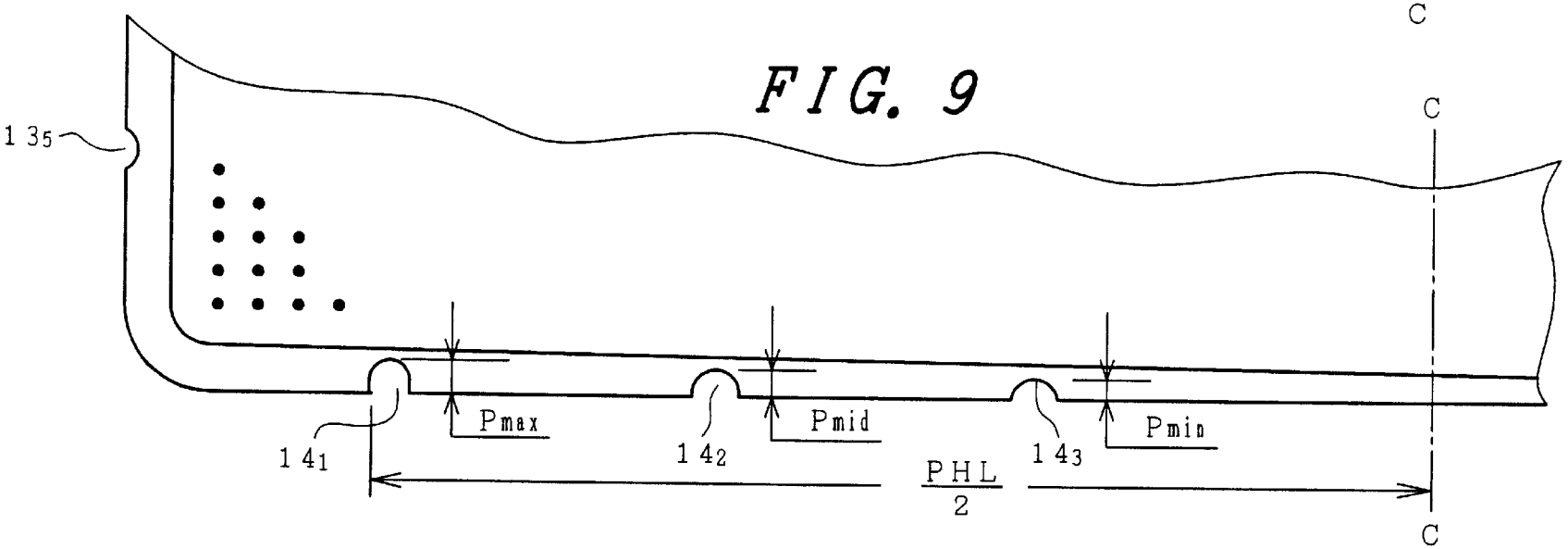
FIG. 9 is an enlarged fragmentary top view of a long side of the skirt portion of the fourth embodiment of a shadow mask used in the color cathode ray tube shown in FIG. 1.

FIGS. 8 and 9 are fragmentary top views of a shadow mask viewed from a phosphor screen side, of a fourth embodiment for use in a 19 inch-diagonal color cathode ray tube, FIG. 8 being a top view of the embossments $\mathbf{13}_1$ and $\mathbf{13}_2$ provided on the short side of the skirt portion of the shadow mask, and FIG. 9 being a top view of the embossments $\mathbf{14}_1$, $\mathbf{14}_2$ and $\mathbf{14}_3$ provided on the long side of the skirt portion of the shadow mask. In this embodiment, when the short-side border of the useful apertured area of the shadow mask is barrel-shaped as shown in FIG. 8, or when long-side border of the useful border is barrel-shaped as shown in FIG. 9, the width of imperforate portion 5N measured in parallel with the centerlines C—C is smaller in the vicinity of the centerline of the respective sides of the shadow mask and is wider in the vicinity of the corners, that is, the border of the curved apertured portion is concave toward a center of the apertured portion.

Accordingly, by configuring the embossments such that, as shown in FIGS. 8 and 9, the depth P of the embossments is smaller in the vicinity of the centerlines C—C of the long and short sides of the shadow mask 5, and is larger than in the vicinity of the ends of the long and short sides of the shadow mask 5 (i.e. in the vicinity of the corners of the shadow mask), deformation of the useful apertured portion of shadow mask is suppressed. In this embodiment it is preferable that the maximum Pmax and the minimum Pmin of the embossments in the skirt portion satisfy the following relationship:

$$0.2 \leqq (P\max - P\min)/P\max \leqq 0.6.$$

While, in the above embodiments, the embossments protrude inwardly, the present invention is not limited thereto, but they can protrude outwardly to provide the similar function and effects.

While, in the above embodiments, the embossments are arcuate in cross section, the present invention is not limited thereto, but they can be rectangular or triangular in cross section.

The results obtained from various experiments similar to the above embodiments are summarized as follows:

(1) It is preferable to distribute slits and embossments over each of central portions extending a distance PHL and a distance PVL in long and short sides of the skirt portion, respectively, wherein PHL and PVL satisfy the following inequalities:

$$0.5HL \leqq PHL \leqq 0.85HL,$$

$$0.5VL \leqq PVL \leqq 0.85VL$$

where HL and VL are longitudinal lengths of the long and short sides of the skirt portion, respectively.

(2) It is preferable that slits and embossments are 2 to 10 and 2 to 15 in number, respectively, in each of the above-mentioned central portions (PHL, PVL).

(3) It is preferable that slits extend a distance of 30 to 70% of the height of the skirt portion from a rear end of the skirt portion on an opposite side thereof from the panel portion of the cathode ray tube.

(4) It is preferable that a width of slits is 25 to 50% of a longitudinal length thereof.

(5) It is preferable that embossments extend a distance of 80 to 100% of the height of the skirt portion.

(6) It is preferable that a cross section of embossments is 4 to 12 mm measured along a side of the skirt portion having the embossments and is 0.2 to 1.0 mm measured perpendicular to the side of the skirt portion.

(7) It is preferable that, when a pair of slits are disposed at a central portion of 2 to 20% of the longitudinal length (HL, VL) of each of long and short sides of the skirt portion, the remainder of the slits are spaced a distance of 10 to 70 mm from each other.

(8) It is preferable that, when a pair of embossments are disposed at a central portion of 5 to 50% of the longitudinal length (HL, VL) of each of long and short sides of the skirt portion, the remainder of the embossments are spaced a distance of 5 to 70 mm from each other.

(9) It is preferable that, when one embossment is disposed at a midpoint of each of long and short sides of the skirt portion, the remainder of the embossments are spaced a distance of 10 to 70 mm from each other.

(10) It is preferable that, when a pair of embossments are disposed at a central portion of 3 to 20% of the longitudinal length (HL, VL) of each of long and short sides of the skirt portion, embossments are spaced a distance of 5 to 35 mm from adjacent ones of slits in a portion excluding the central portion of 3 to 20% of the longitudinal length.

(11) It is preferable that embossments are spaced a distance of 5 to 35 mm from adjacent ones of slits.

(12) It is preferable that zero to four of embossments are disposed between two adjacent ones of slits.

In the present invention, the size of curls occurring the skirt portion of the shadow mask can be greatly reduced, concentration of stress can be prevented from being caused in the apertured portion of the shadow mask by large-sized curls in the skirt portion in the operation of fitting the skirt portion of the shadow mask into a support frame, and consequently deformation of the apertured portion by concentration of stress can be greatly reduced or eliminated to provide a color cathode ray tube free from errors in registration of colors in a displayed image due to deformation of the shadow mask, by forming a plurality of embossments in an area centered about a respective centerline of the long and short sides of the skirt portion of the shadow mask and extending a distance of 50% to 85% of the length of the respective sides to make the maximum Pmax and the minimum Pmin of the embossments in each of the long and short sides satisfy the relationship $0.2 \leqq (Pmax-Pmin)/Pmax \leqq 0.6$ in the operation of press-forming a shadow mask.

Difference in depth between an embossment nearest a respective centerline and an embossment nearest a corner of the long and short sides suppress curls of the skirt portion in the vicinity of weld points and reduce deformation of the useful area of the shadow mask.

What is claimed is:

1. A color cathode ray tube comprising a generally rectangular shadow mask having a curved apertured portion having a multiplicity of electron-transmissive apertures, a curved imperforate portion surrounding and integral with said apertured portion and a skirt portion bent back from a periphery of said curved imperforate portion, and a generally rectangular support frame for suspending said shadow mask by spot welding said skirt portion thereto, within a panel portion of said color cathode ray tube;

wherein said skirt portion is provided with a plurality of embossments and is fitted inside said support frame;

wherein said plurality of embossments protrude inwardly and extend in a direction of a height of said skirt portion; and wherein a distance between a bottom of each of said plurality of embossments and a border of said curved apertured portion is at least 4.5 mm.

2. A color cathode ray tube according to claim 1, wherein a depth and a width of each of said plurality of embossments are in a range of from 0.2 mm to 1.0 mm and in a range of from 4.0 mm to 12.0 mm, respectively.

3. A color cathode ray tube according to claim 1, wherein said plurality of embossments are distributed over each of central portions extending a distance PHL and a distance PVL in long and short sides of said skirt portion, respectively, said PHL and PVL satisfying the following inequalities:

$$0.5HL \leqq PHL \leqq 0.85HL,$$

$$0.5VL \leqq PVL \leqq 0.85VL,$$

and said HL and VL being longitudinal lengths of said long and short sides of said skirt portion, respectively.

4. A color cathode ray tube according to claim 1, wherein a maximum and a minimum of a depth of said plurality of embossments satisfy a following relationship on each of long and short sides of said skirt portion:

$$0.2 \leqq (Pmax-Pmin)/Pmax \leqq 0.6$$

where Pmax is said maximum of said depth and Pmin is said minimum of said depth.

5. A color cathode ray tube according to claim 4, wherein said depth of said plurality of embossments decreases with increasing distance from centerlines of said long and short-sides of said skirt portion.

6. A color cathode ray tube according to claim 4, wherein said depth of said plurality of embossments increases with increasing distance from centerlines of said long and short sides of said skirt portion.

7. A color cathode ray tube according to claim 5, wherein a border of said curved apertured portion in at least one of the directions of long and short sides of said skirt portion is convex toward a center of said curved apertured portion.

8. A color cathode ray tube according to claim 6, wherein a border of said curved apertured portion in at least one of the directions of long and short sides of said skirt portion is concave toward a center of said curved apertured portion.

9. A color cathode ray tube according to claim 1, wherein depths of said plurality of embossments decrease with increasing distance from center lines of said long and short sides of said skirt portion.

10. A color cathode ray tube according to claim 9, wherein the depth and a width of each of said plurality of embossments are in a range of from 0.2 mm to 1.0 mm and in a range of from 4.0 mm to 12.0 mm, respectively.

11. A color cathode ray tube according to claim 9, wherein said plurality of embossments are distributed over each of central portions extending a distance PHL and a distance PVL in long and short sides of said skirt portion, respectively, said PHL and PVL satisfying the following inequalities:

$$0.5HL \leqq PHL \leqq 0.8HL,$$

$$0.5VL \leqq PVL \leqq 0.8VL,$$

and said HL and VL being longitudinal lengths of said long and short sides of said skirt portion, respectively.

12. A color cathode ray tube according to claim 9, wherein a maximum and a minimum of the depths of said plurality of embossments satisfy a following relationship on each of long and short sides of said skirt portion:

$$0.2 \leqq (P\text{max} - P\text{min})/P\text{max} \leqq 0.6$$

where Pmax is said maximum of said depth and Pmin is said minimum of said depth.

13. A color cathode ray tube according to claim 9, wherein a border of said curved apertured portion in at least one of the directions of long and short sides of said skirt portion is convex toward a center of said curved apertured portion.

14. A color cathode ray tube according to claim 9, wherein a border of said curved apertured portion in at least one of the directions of long and short sides of said skirt portion is concave toward a center of said curved apertured portion.

15. A color cathode ray tube according to claim 4, wherein a border of said curved apertured portion in at least one of the directions of long and short sides of said skirt portion is convex toward a center of said curved apertured portion.

16. A color cathode ray tube according to claim 4, wherein a border of said curved apertured portion in at least one of the directions of long and short sides of said skirt portion is concave toward a center of said curved apertured portion.

17. A color cathode ray tube according to claim 1, wherein depths of said plurality of embossments increase with increasing distance from center lines of said long and short sides of said skirt portion.

18. A color cathode ray tube according to claim 17, wherein the depth and a width of each of said plurality of embossments are in a range of from 0.2 mm to 1.0 mm and in a range of from 4.0 mm to 12.0 mm, respectively.

19. A color cathode ray tube according to claim 17, wherein said plurality of embossments are distributed over each of central portions extending a distance PHL and a distance PVL in long and short sides of said skirt portion, respectively, said PHL and PVL satisfying the following inequalities:

$$0.5HL \leqq PHL \leqq 0.8HL,$$

$$0.5VL \leqq PVL \leqq 0.8VL,$$

and said HL and VL being longitudinal lengths of said long and short sides of said skirt portion, respectively.

20. A color cathode ray tube according to claim 17, wherein a maximum and a minimum of the depths of said plurality of embossments satisfy a following relationship on each of long and short sides of said skirt portion:

$$0.2 \leqq (P\text{max} - P\text{min})/P\text{max} \leqq 0.6$$

where Pmax is said maximum of said depth and Pmin is said minimum of said depth.

21. A color cathode ray tube according to claim 17, wherein a border of said curved apertured portion in at least one of the directions of long and short sides of said skirt portion is convex toward a center of said curved apertured portion.

22. A color cathode ray tube according to claim 17, wherein a border of said curved apertured portion in at least one of the directions of long and short sides of said skirt portion is concave toward a center of said curved apertured portion.

* * * * *